US008054263B2

(12) United States Patent
Qi

(10) Patent No.: US 8,054,263 B2
(45) Date of Patent: Nov. 8, 2011

(54) LIQUID CRYSTAL DISPLAY HAVING DISCHARGING CIRCUIT

(75) Inventor: Xiao-Jing Qi, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 1044 days.

(21) Appl. No.: 11/978,317

(22) Filed: Oct. 29, 2007

(65) Prior Publication Data

US 2008/0100331 A1 May 1, 2008

(30) Foreign Application Priority Data

Oct. 27, 2006 (TW) ..... 95139814 A

(51) Int. Cl.
*G09G 3/36* (2006.01)

(52) U.S. Cl. ..... 345/87; 324/760.01

(58) Field of Classification Search ..... 345/87, 345/904; 324/760.01, 760.02, 770; 349/40
See application file for complete search history.

(56) References Cited

U.S. PATENT DOCUMENTS

| | | | | |
|---|---|---|---|---|
| 5,448,384 | A | 9/1995 | Uchino et al. | |
| 5,936,687 | A * | 8/1999 | Lee | 349/40 |
| 6,064,360 | A * | 5/2000 | Sakaedani et al. | 345/211 |
| 6,903,734 | B2 | 6/2005 | Eu | |
| 2006/0077162 | A1 * | 4/2006 | Chou et al. | 345/92 |
| 2006/0145155 | A1 * | 7/2006 | Choi et al. | 349/43 |

FOREIGN PATENT DOCUMENTS

| | | | |
|---|---|---|---|
| CN | 1447306 | A | 10/2003 |
| KR | 1020050101865 | * | 5/2007 |

* cited by examiner

*Primary Examiner* — Chanh Nguyen
*Assistant Examiner* — Allison Walthall
(74) *Attorney, Agent, or Firm* — Altis Law Group, Inc.

(57) ABSTRACT

An exemplary liquid crystal display (200) includes a liquid crystal panel, a gate driving circuit (210), and a data driving circuit (220). The liquid crystal panel includes a pixel array (230), a short-circuit test circuit (240), and a control circuit (290). The short-circuit test circuit and the control circuit cooperatively form a discharging circuit. When the liquid crystal display is powered off, electric charge stored in the liquid crystal panel is discharged through the discharging circuit. The gate driving circuit is configured for scanning the liquid crystal panel. The data driving circuit is configured for providing gray-scale voltages to the liquid crystal panel when the liquid crystal panel is scanned.

19 Claims, 2 Drawing Sheets

LIQUID CRYSTAL DISPLAY HAVING DISCHARGING CIRCUIT

FIELD OF THE INVENTION

The present invention relates liquid crystal displays (LCDs), and particularly to an LCD which includes a discharging circuit for avoiding a residual image phenomenon.

GENERAL BACKGROUND

An LCD has the advantages of portability, low power consumption, and low radiation, and has been widely used in various portable information products such as notebooks, personal digital assistants (PDAs), video cameras and the like. Furthermore, the LCD is considered by many to have the potential to completely replace CRT (cathode ray tube) monitors and televisions. An LCD generally includes a liquid crystal panel, a driving circuit for driving the liquid crystal panel, and a backlight module for illuminating the liquid crystal panel.

FIG. 2 is essentially an abbreviated circuit diagram of a typical LCD 100. The LCD 100 includes a liquid crystal panel (not shown), a gate driving circuit 110 and a data driving circuit 120. The gate driving circuit 110 and the data driving circuit 120 are formed on the liquid crystal panel by a chip on glass (COG) method. The gate driving circuit 110 is used to scan the liquid crystal panel. The data driving circuit 120 is used to provide gray-scale voltages to the liquid crystal panel when the liquid crystal panel is scanned.

The liquid crystal panel includes a pixel array 130 and a short-circuit test circuit 140. The pixel array 130 includes a number of gate lines 111 that are parallel to each other and that each extend along a first direction, and a number of data lines 121 that are parallel to each other and that each extend along a second direction orthogonal to the first direction. The gate lines 111 and data lines 121 cross each other, thereby defining an array of pixel units 150. The gate lines 111 are connected to the gate driving circuit 110. The data lines 121 are connected to the data driving circuit 120.

Each pixel unit 150 includes a thin film transistor (TFT) 151, a storage capacitor 152, and a common electrode 153. A gate electrode (not labeled), a source electrode (not labeled), and a drain electrode (not labeled) of the TFT 151 are connected to a corresponding gate line 111, a corresponding data line 121, and a terminal of the storage capacitor 152 respectively. The other terminal of the storage capacitor 152 is connected to the common electrode 153. The TFT 151 functions as a switching element for charging and discharging of the storage capacitor 152.

The short-circuit test circuit 140 includes a plurality of switching TFTs 141, a test control line 142, a first test lead 1401, a second test lead 1402, a third test lead 1403, a fourth test lead 1404, and a fifth test lead 1405. Each of odd-numbered gate lines 111 is connected to the third test lead 1403 via a drain electrode and a source electrode of a corresponding switching TFT 141. Each of even-numbered gate lines 111 is connected to the fourth test lead 1404 via a drain electrode and a source electrode of a corresponding switching TFT 141. Each of odd-numbered data lines 121 is connected to the first test lead 1401 via a source electrode and a drain electrode of a corresponding switching TFT 141. Each of even-numbered data lines 121 is connected to the second test lead 1402 via a source electrode and a drain electrode of a corresponding switching TFT 141. The fifth test lead 1405 is connected with gate electrodes of the switching TFTs 141 and finally the gate driving circuit 110 in series via the test control line 142. The structure of the short-circuit test circuit 140 is a so-called 2G2D structure.

The short-circuit test circuit 140 is generally used to test whether the gate lines 111 and the data lines 121 are damaged or not before the driving circuits 110, 120 are attached to the liquid crystal panel. When the liquid crystal panel is tested, each of the test leads 1401, 1402, 1403, 1404, 1405 receives a test signal. The fifth test lead 1405 provides a high-voltage signal to switch on the switching TFTs 141. The third test lead 1403 provides a high voltage to odd-numbered gate lines 111 to switch on odd-row TFTs 151. The fourth test lead 1404 provides a high voltage to even-numbered gate lines 111 to switch on even-row TFTs 151. The first and second test leads 1401, 1402 provide gray-scale voltages to the storage capacitors 152 respectively via odd-numbered data lines 121 and even-numbered data lines 121, thereby displaying test images on the liquid crystal panel. After the gate driving circuit 110 is attached onto the liquid crystal panel, the gate driving circuit 110 provides a low voltage to the gate electrodes of the switching transistors 141 via the test control line 142 so as to deactivate the short-circuit test circuit 140.

The LCD 100 is powered on by an external power supply (not shown), which connects with the LCD 100 via an external power supply connection of the LCD 100. After the LCD 100 is powered on, the gate driving circuit 110 provides a high voltage to the gate lines 111 so as to switch on the TFTs 151. The data driving circuit 120 provides a gray-scale voltage to the storage capacitors 152 via the data lines 121 and the activated TFTs 151. After being charged, the storage capacitors 152 each store a changeless amount of electric charge until a next gray-scale voltage is applied thereto.

When the LCD 100 is powered off, electric charge stored in the storage capacitors 152 generally cannot be discharged quickly. This makes the voltage at the external power supply connection drop slowly. As a result, the gate driving circuit 110 and the data driving circuit 120 operate incorrectly, thereby producing a residual image on the liquid crystal panel.

What is needed, therefore, is a new LCD that can overcome the above-described deficiencies.

SUMMARY

In one preferred embodiment, a liquid crystal display includes a liquid crystal panel, a gate driving circuit, and a data driving circuit. The liquid crystal panel includes a pixel array, a short-circuit test circuit, and a control circuit. The short-circuit test circuit and the control circuit cooperatively form a discharging circuit. When the liquid crystal display is powered off, electric charge stored in the liquid crystal panel is discharged through the discharging circuit. The gate driving circuit is configured for scanning the liquid crystal panel. The data driving circuit is configured for providing gray-scale voltages to the liquid crystal panel when the liquid crystal panel is scanned.

Other novel features and advantages will become more apparent from the following detailed description when taken in conjunction with the accompanying drawings.

DETAILED DESCRIPTION OF PREFERRED EMBODIMENTS

Figure 1:
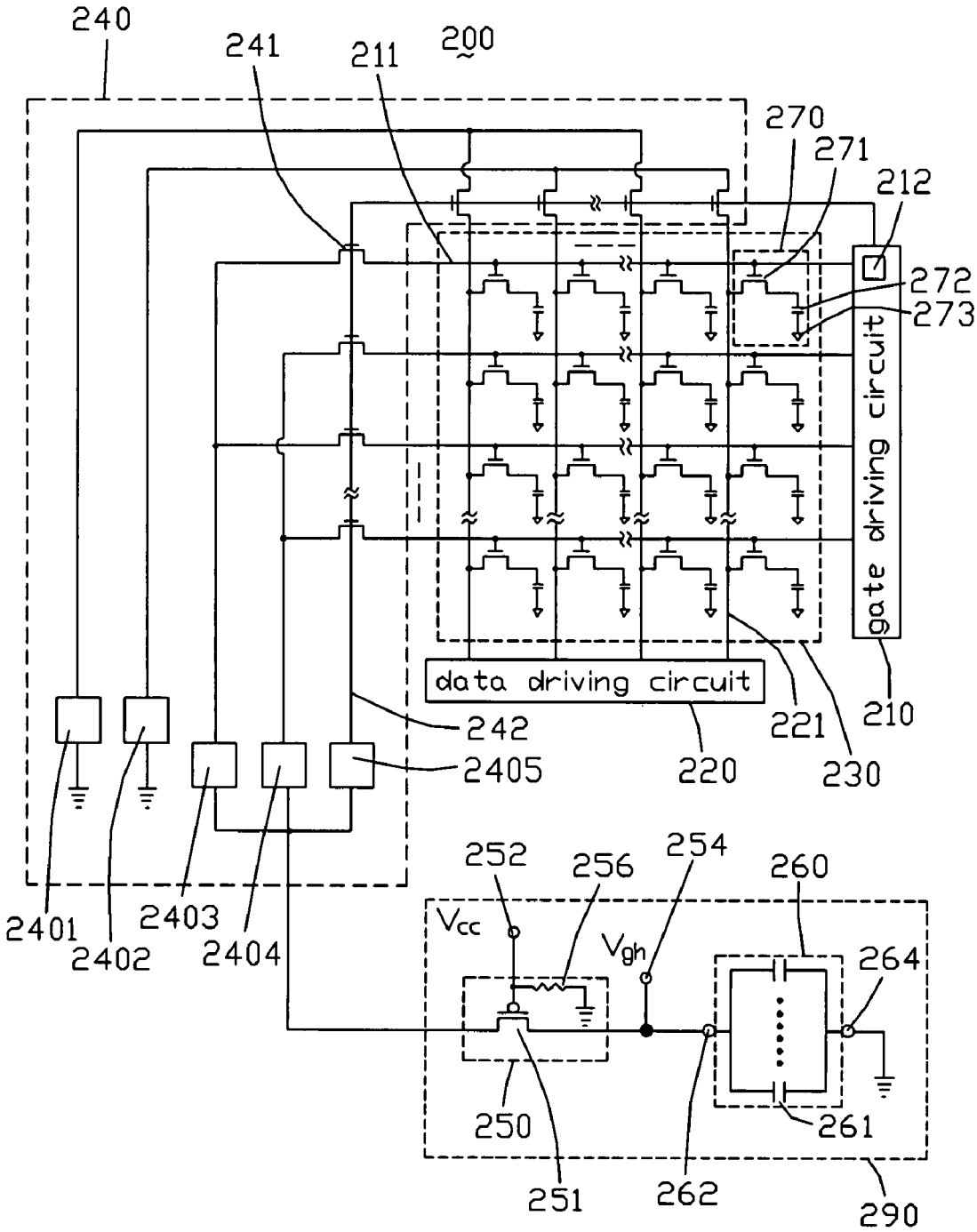
FIG. 1 is essentially an abbreviated circuit diagram of an LCD according to an exemplary embodiment of the present invention.
Figure 2:
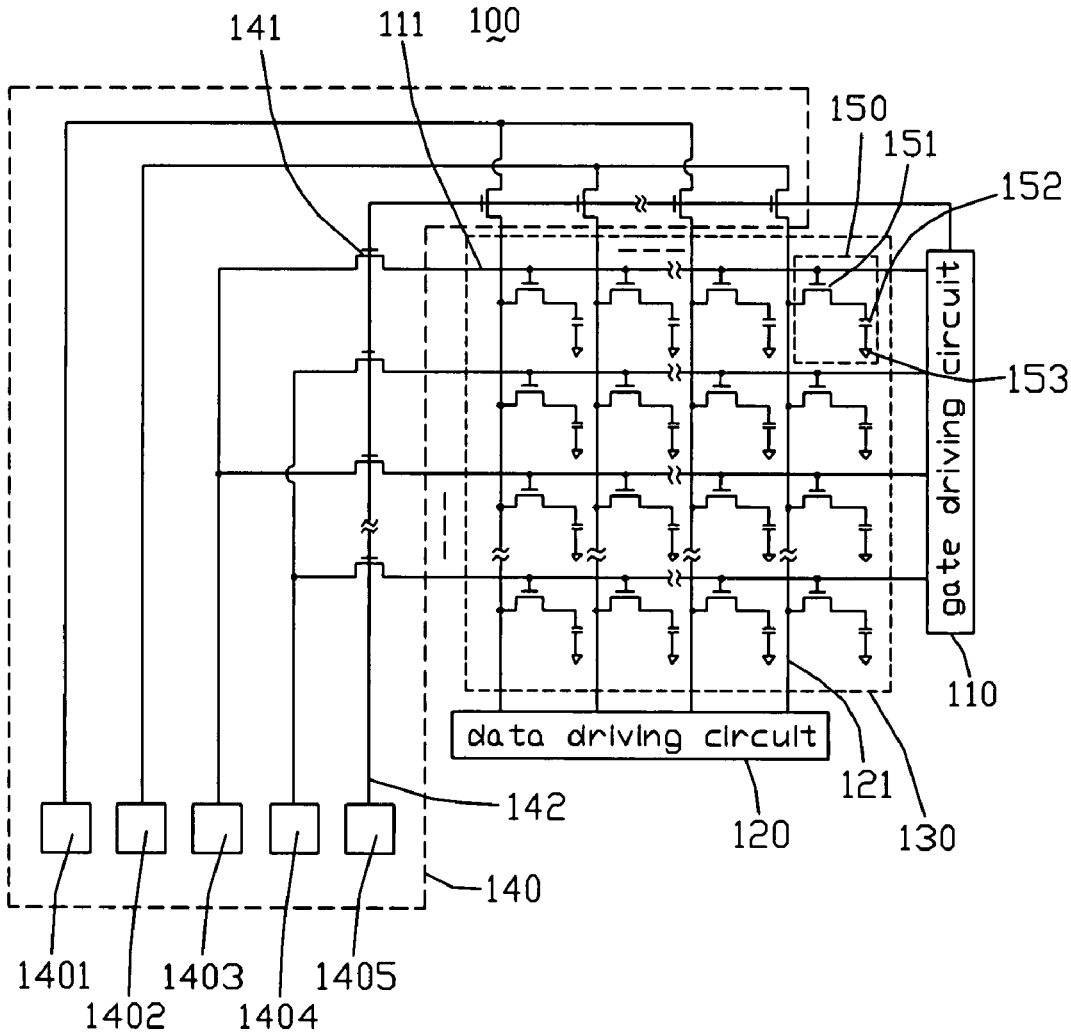
FIG. 2 (RELATED ART)
FIG. 2 is essentially an abbreviated circuit diagram of a conventional LCD.

Referring to FIG. 1, an LCD 200 according to an exemplary embodiment of the present invention is shown. The LCD 200 includes a liquid crystal panel (not shown), a gate driving circuit 210, and a data driving circuit 220. Typically, the gate driving circuit 210 and the data driving circuit 220 are formed on the liquid crystal panel by a chip on glass (COG) method. The gate driving circuit 210 is used to scan the liquid crystal panel. The data driving circuit 120 is used to provide gray-scale voltages to the liquid crystal panel when the liquid crystal panel is scanned.

The liquid crystal panel includes a pixel array 230, a short-circuit test circuit 240, and a control circuit 290. The short-circuit test circuit 240 and the control circuit 290 cooperatively form a discharging circuit. When the LCD 200 is powered off, electric charge stored in the liquid crystal panel is discharged quickly via the discharging circuit.

The pixel array 230 includes a number of gate lines 211 that are parallel to each other and that each extend along a first direction, and a number of data lines 221 that are parallel to each other and that each extend along a second direction orthogonal to the first direction. The gate lines 211 and data lines 221 cross each other, thereby defining an array of pixel units 270. The gate lines 211 are connected to the gate driving circuit 210. The data lines 221 are connected to the data driving circuit 220.

Each pixel unit 270 includes a thin film transistor (TFT) 271, a storage capacitor 272, and a common electrode 273. A gate electrode (not labeled), a source electrode (not labeled), and a drain electrode (not labeled) of the TFT 271 are connected to a corresponding gate line 211, a corresponding data line 221, and a terminal of the storage capacitor 272 respectively. The other terminal of the storage capacitor 272 is connected to the common electrode 273. The TFT 271 functions as a switching element for charging and discharging of the storage capacitor 272.

The short-circuit test circuit 240 includes a plurality of switching transistors 241, a test control line 242, a first test lead 2401, a second test lead 2402, a third test lead 2403, a fourth test lead 2404, and a fifth test lead 2405. Typically, the switching transistors 241 are switching TFTs 241. In the illustrated embodiment, the first, second, third, fourth, and fifth test leads 2401, 2402, 2403, 2404, 2405 include conductive pads. Each of odd-numbered gate lines 211 is connected to the third test lead 2403 via a drain electrode and a source electrode of a corresponding switching TFT 241. Each of even-numbered gate lines 211 is connected to the fourth test lead 2404 via a drain electrode and a source electrode of a corresponding switching TFT 241. Each of odd-numbered data lines 221 is connected to the first test lead 2401 via a source electrode and a drain electrode of a corresponding switching TFT 241. Each of even-numbered data lines 221 is connected to the second test lead 2402 via a source electrode and a drain electrode of a corresponding switching TFT 241. The fifth test lead 2405 is connected with gate electrodes of the switching TFTs 241 in series via the test control line 242. Before the driving circuits 210, 220 are attached onto the liquid crystal panel, the short-circuit test circuit 230 receives external test signals through the five test leads 2401, 2402, 2403, 2404, 2405 to test the liquid crystal panel. After the driving circuits 210, 220 are attached onto the liquid crystal panel, the first and second test leads 2401, 2402 are connected to ground, and the test control line 242 is connected to the gate driving circuit 210.

The gate driving circuit 210 includes a power-off protection circuit 212. When the LCD 200 is powered off, the power-off protection circuit 212 immediately disconnects the gate driving circuit 210 from the test control line 242.

The control circuit 290 includes a switching circuit 250, a charge storage circuit 260, a first direct current (DC) input terminal 252, and a second DC input terminal 254. The switching circuit 250 includes a p-channel metal oxide semiconductor field effect transistor (P-MOSFET) 251 and a grounding resistor 256. The charge storage circuit 260 includes a first terminal 262, a second terminal 264, and a plurality of capacitors 261 connected in parallel between the first and second terminals 262, 264. A gate electrode of the P-MOSFET 251 is connected to the first DC input terminal 252, and is connected to ground via the grounding resistor 256. A drain electrode of the P-MOSFET 251 is connected to the third, fourth and fifth test leads 2403, 2404, 2405. A source electrode of the P-MOSFET 251 is connected to the second DC input terminal 254, and is connected to the first terminal 262 of the charge storage circuit 260.

Typical operation of the LCD 200 is as follows:

After the LCD 200 is powered on, a 10V direct current voltage $V_{cc}$ is applied to the first DC input terminal 252, and a 10V direct current voltage $V_{gh}$ provided by the gate driving circuit 210 is applied to the second DC input terminal 254. Thus, a voltage difference between the gate and source electrodes of the P-MOSFET 251 is equal to zero, and therefore the P-MOSFET 251 is in an off state. The second DC input terminal 254 charges the charge storage circuit 260.

The gate driving circuit 210 provides a high voltage to the gate lines 211 so as to switch on the TFTs 271. The data driving circuit 220 provides a gray-scale voltage to the storage capacitors 272 via the data lines 221 and the activated TFTs 271. After being charged, the storage capacitors 272 each store a changeless amount of electric charge until a next gray-scale voltage is applied thereto.

After the LCD 200 is powered off, the voltage $V_{cc}$ applied to the first DC input terminal 252 and the voltage $V_{gh}$ applied to the second DC input terminal 254 are both cut off. Because the gate electrode of the P-MOSFET 251 is connected to ground via the grounding resistor 256, the gate electrode of the P-MOSFET 251 has zero voltage. The charge storage circuit 260 was previously charged by the second DC input terminal 254, and thereby has a voltage of 10V. Because the source electrode of the P-MOSFET 251 is connected to the charge storage circuit 260, the voltage difference between the gate and source electrodes of the P-MOSFET 251 is equal to −10V, and thus the P-MOSFET 251 is switched on. The charge storage circuit 260 applies a high voltage to the gate electrodes of the switching TFTs 241 via the activated P-MOSFET 251, the fifth test lead 2405 and the test control line 242 so as to switch on the switching TFTs 241. The charge storage circuit 260 also applies a high voltage to the gate lines 211 via the third and fourth test leads 2403, 2404 and the activated switching TFTs 241 so as to switch on the TFTs 271. Thus, charges stored in the storage capacitors 272 are discharged via the activated TFTs 271, the data lines 221, and the first and second test leads 2401, 2402. Thereby, a residual image phenomenon can be avoided.

In summary, a residual image phenomenon can be avoided by using the short-circuit test circuit 240 and the control circuit 290, without any need to change circuit configurations of the gate driving circuit 210 and the data driving circuit 220. That is, given that the short-circuit test circuit 240 is a necessary component and already provided, the simple addition of the control circuit 290 to the short-circuit test circuit 240 creates a combination that constitutes the discharging circuit. The LCD 200 is thus conveniently provided with the discharging circuit so that the display quality of the LCD 200 can be improved.

It is to be further understood that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid crystal display comprising:

a liquid crystal panel comprising a pixel array, a short-circuit test circuit, and a control circuit, the short-circuit test circuit and the control circuit cooperatively forming a discharging circuit, the control circuit comprising a first direct current input terminal, a second direct current terminal, a switching circuit and a charge storage circuit, the short-circuit test circuit, the switching circuit and the charge storage circuit being connected to ground in series, the switching circuit comprising a p-channel metal oxide semiconductor field effect transistor (P-MOSFET) and a grounding resistor, a gate electrode of the P-MOSFET being connected to the first direct current input terminal, and being further connected to ground via the grounding resistor, a drain electrode of the P-MOSFET being connected to the short-circuit test circuit, and a source electrode of the P-MOSFET being connected to the charge storage circuit and the second direct current input terminal;

a gate driving circuit configured for scanning the liquid crystal panel; and a data driving circuit configured for providing gray-scale voltages to the liquid crystal panel when the liquid crystal panel is scanned;

wherein when the liquid crystal display is powered off, electric charge stored in the liquid crystal panel is discharged through the discharging circuit.

2. The liquid crystal display as claimed in claim 1, wherein the charge storage circuit comprises a first terminal and a second terminal, the first terminal being connected to the source electrode of the P-MOSFET, and the second terminal being connected to ground.

3. The liquid crystal display as claimed in claim 2, wherein the charge storage circuit further comprises a plurality of capacitors connected in parallel between the first terminal and the second terminal.

4. The liquid crystal display as claimed in claim 1, wherein the short-circuit test circuit comprises a test control line, a plurality of switching thin film transistors (TFTs), a first test lead, a second test lead, a third test lead, a fourth test lead, and a fifth test lead, the first and second test leads being connected to ground, the third, fourth and fifth test leads being connected to the drain electrode of the P-MOSFET, and the fifth test lead being further connected with gate electrodes of the switching TFTs and finally the gate driving circuit in series via the test control line.

5. The liquid crystal display as claimed in claim 4, wherein the gate driving circuit comprises a power-off protection circuit, and when the liquid crystal display is powered off, the power-off protection circuit immediately disconnects the gate driving circuit from the test control line.

6. The liquid crystal display as claimed in claim 4, wherein the pixel array comprises a number of gate lines that are parallel to each other and that each extend along a first direction, and a number of data lines that are parallel to each other and that each extend along a second direction orthogonal to the first direction, the gate lines and data lines crossing each other, thereby defining an array of pixel units.

7. The liquid crystal display as claimed in claim 6, wherein each of odd-numbered gate lines is connected to the third test lead via a drain electrode and a source electrode of a corresponding switching TFT, each of even-numbered gate lines is connected to the fourth test lead via a drain electrode and a source electrode of a corresponding switching TFT, each of odd-numbered data lines is connected to the first test lead via a source electrode and a drain electrode of a corresponding switching TFT, and each of even-numbered data lines is connected to the second test lead via a source electrode and a drain electrode of a corresponding switching TFT.

8. The liquid crystal display as claimed in claim 7, wherein each of the pixel units comprising a thin film transistor (TFT), a storage capacitor, and a common electrode, a gate electrode, a source electrode, and a drain electrode of the TFT being connected to a corresponding gate line, a corresponding data line, and a terminal of the storage capacitor respectively, the other terminal of the storage capacitor being connected to the common electrode.

9. The liquid crystal display as claimed in claim 1, wherein the gate driving circuit and the data driving circuit are formed on the liquid crystal panel by a chip on glass method.

10. The liquid crystal display as claimed in claim 1, wherein the first direct current input terminal is connected to a 10 volt direct current voltage, and the second direct current input is connected to a 10 volt current voltage.

11. The liquid crystal display as claimed in claim 10, wherein when the liquid crystal display is powered on, the first and the second direct current input terminals are connected to the 10 volt direct current voltages respectively such that the P-MOSFET is switched off and the charge storage circuit is charged, and when the liquid crystal display is powered off, the first and the second direct current input terminals are disconnected from the 10 volt direct current voltages respectively such that the P-MOSFET is switched on and the charge storage circuit is discharged.

12. A liquid crystal display comprising:

a liquid crystal panel comprising a pixel array, a short-circuit test circuit, and a control circuit, the short-circuit test circuit and the control circuit cooperatively forming a discharging circuit, the control circuit comprising a first direct current input terminal, a second direct current terminal, a switching circuit and a charge storage circuit, the short-circuit test circuit, the switching circuit and the charge storage circuit being connected to ground in series, the switching circuit comprising a transistor, a gate electrode of the transistor being connected to the first direct current input terminal, a drain electrode of the transistor being connected to the short-circuit test circuit, and a source electrode of the transistor being connected to the charge storage circuit and the second direct current input terminal;

a gate driving circuit configured for scanning the liquid crystal panel; and a data driving circuit configured for providing gray-scale voltages to the liquid crystal panel when the liquid crystal panel is scanned;

wherein when the liquid crystal display is powered off, electric charge stored in the liquid crystal panel is discharged through the discharging circuit, and the short-circuit test circuit comprises a test control line, a plurality of switching thin film transistors (TFTs), a first test lead, a second test lead, a third test lead, a fourth test lead, and a fifth test lead, the first and second test leads being connected to ground, the third, fourth and fifth test leads being connected to the drain electrode of the transistor of the switching circuit, and the fifth test lead being further connected with gate electrodes of the switching TFTs and finally the gate driving circuit in series via the test control line.

13. The liquid crystal display as claimed in claim 12, wherein the pixel array comprises a number of gate lines that are parallel to each other and that each extend along a first direction, and a number of data lines that are parallel to each other and that each extend along a second direction orthogonal to the first direction, the gate lines and data lines crossing each other, thereby defining an array of pixel units.

14. The liquid crystal display as claimed in claim 13, wherein each of odd-numbered gate lines is connected to the third test lead via a drain electrode and a source electrode of a corresponding switching TFT, each of even-numbered gate lines is connected to the fourth test lead via a drain electrode and a source electrode of a corresponding switching TFT, each of odd-numbered data lines is connected to the first test lead via a source electrode and a drain electrode of a corresponding switching TFT, and each of even-numbered data lines is connected to the second test lead via a source electrode and a drain electrode of a corresponding switching TFT.

15. The liquid crystal display as claimed in claim 14, wherein the first direct current input terminal is connected to a first direct current voltage, and the second direct current input is connected to a second current voltage, the second current voltage substantially equaling to the first current voltage.

16. The liquid crystal display as claimed in claim 15, wherein when the liquid crystal display is powered on, the first and the second direct current input terminals are connected to the first and the second direct current voltages respectively such that the transistor of the switching circuit is switched off and the charge storage circuit is charged, and when the liquid crystal display is powered off, the first and the second direct current input terminals are disconnected from the first and the second direct current voltages respectively such that the transistor of the switching circuit is switched on and the charge storage circuit is discharged.

17. The liquid crystal display as claimed in claim 16, wherein the second current voltage is provided by the gate driving circuit.

18. The liquid crystal display as claimed in claim 17, wherein the charge storage circuit comprises a first terminal and a second terminal, the first terminal being connected to the source electrode of the transistor of the switching circuit, and the second terminal being connected to ground.

19. The liquid crystal display as claimed in claim 18, wherein the charge storage circuit further comprises a plurality of capacitors connected in parallel between the first terminal and the second terminal.

* * * * *